US007017844B1

(12) United States Patent
Racine et al.

(10) Patent No.: US 7,017,844 B1
(45) Date of Patent: Mar. 28, 2006

(54) WEAR PLATES FOR THE VERTICAL ROTOR OF A PULVERIZER

(75) Inventors: Randal M. Racine, Westfield, MA (US); Danny L. Vaughn, Roxboro, NC (US)

(73) Assignee: ALSTOM Technology Ltd, Baden (CH)

( * ) Notice: Subject to any disclaimer, the term of this patent is extended or adjusted under 35 U.S.C. 154(b) by 0 days.

(21) Appl. No.: 10/970,910

(22) Filed: Oct. 22, 2004

(51) Int. Cl.
*B02C 13/26* (2006.01)

(52) U.S. Cl. ..... 241/300; 241/188.1

(58) Field of Classification Search ..... 241/300, 241/301, 188.1, 189.1, 197
See application file for complete search history.

(56) References Cited

U.S. PATENT DOCUMENTS 2,021,762 A * 11/1935 Armour ..... 241/191
2,474,305 A * 6/1949 Ollison ..... 241/195
2,639,863 A * 5/1953 Rogers ..... 241/191
3,157,366 A * 11/1964 Rogers ..... 241/188.1

* cited by examiner

*Primary Examiner*—Mark Rosenbaum
(74) *Attorney, Agent, or Firm*—Arthur E. Fournier, Jr.; Timothy J. Olson

(57) ABSTRACT

A wear plate 52 for mounting in a wear protecting disposition on a rotor disc 50 of a pulverizer 38 includes a body portion 64 having a radially outer circumferential edge 74 and a radially inner circumferential edge 76, an abutment shoulder 72 along the one angular edge of the wear plate 52, an underlap flange 78 on the one angular edge of the body portion 64, and an overlap rim 80 on the other angular edge of the body portion 64. The underlap flange 78 is cooperatively configured with respect to an overlap rim 80 of a respective adjacent wear plate 52 that is in interengagement with the wear plate 52 such that the overlap rim 80 of the respective adjacent wear plate 52 at least partially overlaps the underlap flange 78 of the wear plate 52.

3 Claims, 6 Drawing Sheets

WEAR PLATES FOR THE VERTICAL ROTOR OF A PULVERIZER

BACKGROUND OF THE INVENTION

The invention relates to a wear plate for mounting in a wear protecting disposition on a rotor disc of a pulverizer.

A particular type of pulverizer for size reducing solid material such as, for example, coal, comprises a raw coal inlet, a crusher dryer section, a pulverizing section, a fan section, and pulverized coal outlet. The crusher dryer section includes a plurality of beater blades all commonly mounted on a main horizontal shaft of the pulverizer, the beater blades cooperating with a grid section to effect an initial size reduction of the raw coal introduced into the pulverizer via the raw coal inlet. The pulverizing section includes a rotor disc also mounted on the main horizontal shaft for rotation thereby and a plurality of wear plates mounted on both respective axial surfaces of the rotor disc.

As the solid material is subjected to the pulverization by the pulverizing section, particles thereof migrate through the gaps between adjacent wear plates. These particles then cause wear and pitting of the underlying rotor disc including grooving of the rotor disc. Such wear and pitting of the rotor disc must then be remedied by costly resurfacing of the rotor disc or may even necessitate the replacement of the rotor disc before its hoped-for useful life.

Accordingly, the need still exists for an approach to controlling or limiting the migration of pulverized material through the gaps of the wear plates so as to thereby minimize wear and pitting on the underlying rotor disc. Such an approach should preferably be inexpensive to manufacture and should be as compatible as possible with existing wear plate and rotor disc arrangements so as to facilitate the installation and use thereof. Also, the approach should be suitable for use in the relatively harsh environment of a coal pulverizing operation including being subjected to the abrasive effects of coal. The system also should be simple and reliable, in order to keep maintenance costs to a minimum.

Accordingly, it is an object of the present invention to provide a wear plate arrangement that addresses the concerns set forth above.

SUMMARY OF THE INVENTION

According to the present invention, a wear plate for mounting in a wear protecting disposition on a rotor disc of a pulverizer is provided that advantageously minimizes the migration of pulverized solid material between adjacent wear plates.

According to one aspect of the present invention, a wear plate is provided for mounting in a wear protecting disposition on a rotor disc of a pulverizer, wherein the rotor disc is rotatable about a rotor axis. The inventive wear plate comprises a body portion, an abutment shoulder, an underlap flange, and an overlap rim.

In accordance with further details of the one aspect of the present invention, the body portion has a radially outer circumferential edge and a radially inner circumferential edge, an angular edge extending angularly between the radially outer circumferential edge and the radially inner circumferential edge on one side of the body portion and another angular edge extending angularly between the radially outer circumferential edge and the radially inner circumferential edge on an opposed side of the body portion.

Also, the body portion of the wear plate includes an axially inner surface disposed in facing relationship to the rotor disc in the wear protecting disposition of the wear plate on the rotor disc.

The abutment shoulder extends from the radially outer circumferential edge of the body portion to the radially inner circumferential edge of the body portion along the one angular edge of the wear plate. Additionally, the abutment shoulder has an linear elongate extent from the inner circumferential edge of the body portion to a location near the outer circumferential edge of the body portion, whereat the abutment shoulder has an overall curved hook shape terminating at the outer circumferential edge of the body portion. Moreover, in accordance with the one aspect of the present invention, the underlap flange is located on the one angular edge of the body portion and extends in its width dimension outwardly in the angular direction from the abutment shoulder, in its length dimension from the radially outer circumferential edge of the body portion to the radially inner circumferential edge of the body portion and in its thickness dimension in the axial direction from the axially inner surface of the wear plate to a thickness less than the thickness of the abutment shoulder. Also, the overlap rim is located on the other angular edge of the body portion. The underlap flange is cooperatively configured with respect to an overlap rim of a respective adjacent wear plate that is in interengagement with the wear plate such that the overlap rim of the respective adjacent wear plate at least partially overlaps the underlap flange of the wear plate.

According to further details of the one aspect of the present invention, the body portion has at least one bore for registry with an underlying bore in the rotor disc such that a securement bolt can be extended through the pair of aligned bores and secured with a nut. Furthermore, the overlap rim has an axially inner surface whose curvature tracks the curvature of the axially outer surface of the underlap flange of the adjacent wear plate.

DETAILED DESCRIPTIONS OF THE PREFERRED EMBODIMENT

Figure 1:
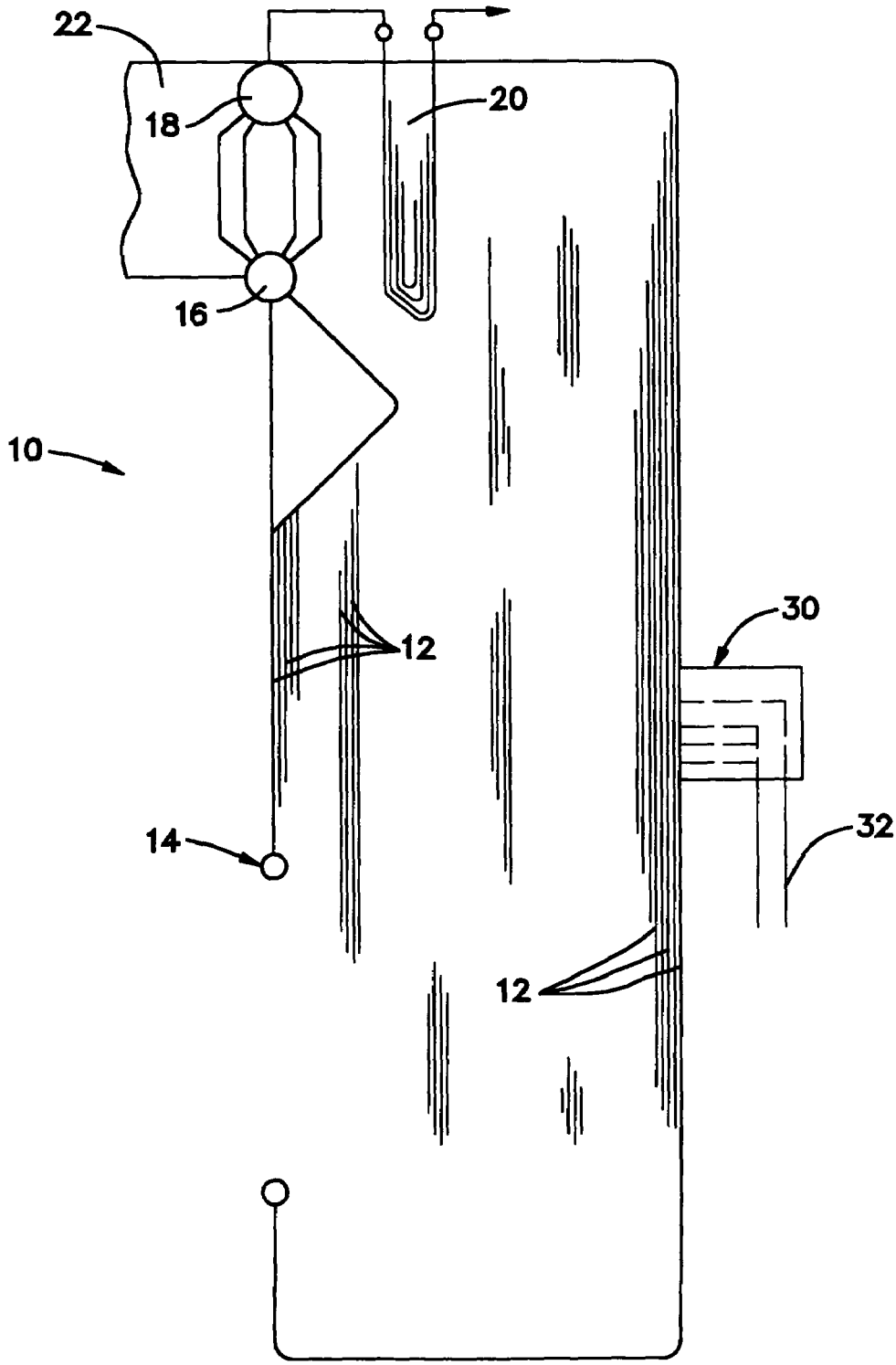
FIG. 1 is a schematic sectional elevational view of a fossil fuel combustion chamber operable to combust coal that has been size reduced by a horizontal shaft-type pulverizer.

Reference is now had to FIG. 1, which is a schematic sectional elevational view of a fossil fuel combustion chamber 10 operable in conventional manner to combust a fossil fuel such as, for example, coal. The combustion chamber 10 comprises an enclosure whose walls are formed by tubes 12 communicated with headers 14. The headers receive water from a lower drum 16 through downcomers (not shown). A mixture of steam and water exits from the upper ends of tubes 12 into an upper drum 18. Flue gas generated in the combustion chamber 10 passes in heat exchange contact with conventional heat exchange surfaces such as, for example, a superheater 20 as it flows to and along a backpass 22.

Referring now more particularly to the fossil fuel delivery arrangement of the combustion chamber 10, the fuel for the combustion within the combustion chamber 10 is fossil fuel in the form of coal 24 and the coal 24 is subjected to appropriate handling and treatment to transform the coal from the condition in which it is delivered to the location of the combustion chamber 10 into suitable condition for the coal to be introduced into and combusted within the combustion chamber 10. One typical component of the handling and treatment of fossil fuel such as the coal 24 is a particle size reduction treatment by which the raw untrammeled coal is subjected to a combination of mechanical impact and thermal treatment effective to reduce the average individual coal piece size and, most preferably, effective to reduce the average individual coal piece size to a particle size that can be transported by air entrainment from the particle size reduction location to and into the combustion chamber 10.

Figure 2:
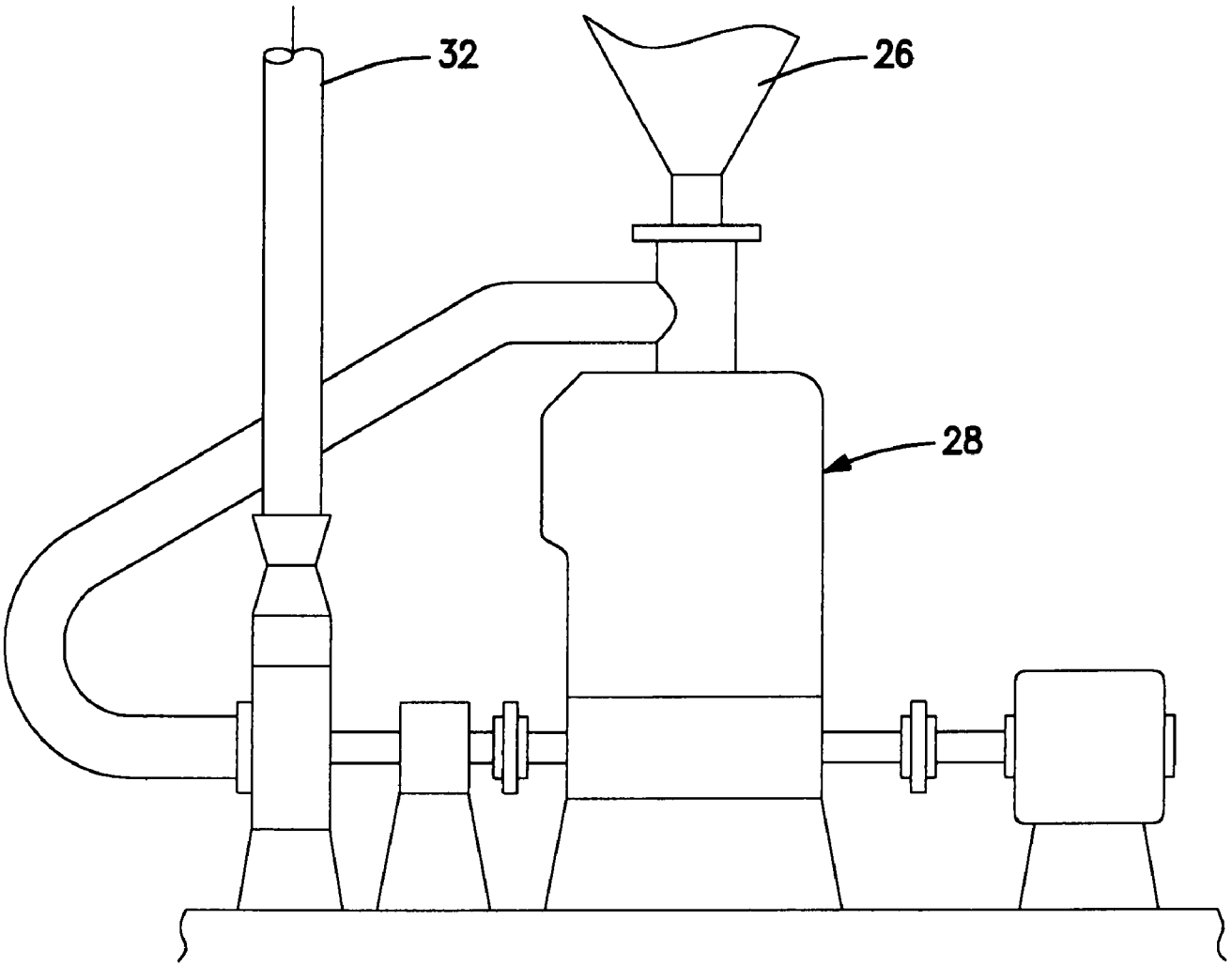
FIG. 2 is a sectional elevational view of the coal delivery arrangement for feeding pulverized coal to the fossil fuel combustion chamber shown in FIG. 1, the coal delivery arrangement comprising a horizontal shaft-type pulverizer having the one embodiment of the wear plate of the present invention.

With reference now to FIG. 2, the coal 24 is stored in a coal silo 26 and is fed therefrom in a metered manner to a solid fuel pulverizer and exhauster system 28 comprising a pulverizer and an exhauster for effecting delivery of a mixture of hot gases and entrained fine coal particles from the pulverizer 14 to the combustion chamber 10. The combustion chamber 10 operates in conventional manner to combust the pulverized solid fuel and air fed thereinto as the pulverized solid fuel and air is injected into the combustion chamber 10 through a plurality of burners 30.

In a coal feed operation, raw untrammeled solid fuel, which may be in the form of coal, is fed from the coal storage silo 26 to the pulverizer and is pulverized within the pulverizer of the solid fuel pulverizer and exhauster system 28. In turn, the pulverizer is connected to the exhauster whereby the solid fuel that is pulverized within the pulverizer is entrained therewithin in an airstream and while so entrained therein is conveyed by the exhauster through an exhauster outlet duct 32 to the burners 30, whereupon the pulverized solid fuel is injected into the combustion chamber 10 by the burners 30 and combusted within the combustion chamber 10.

Figure 3:
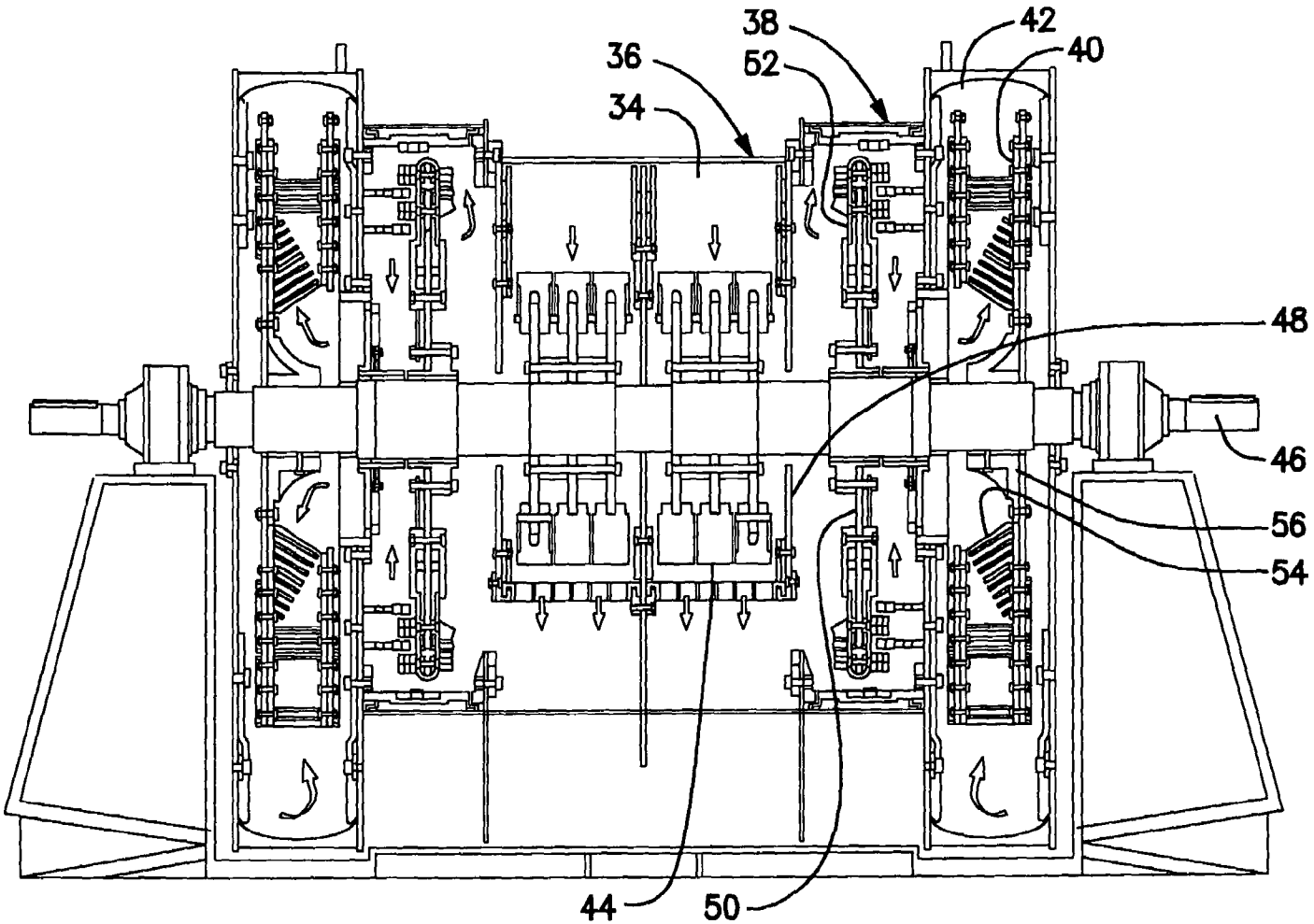
FIG. 3 is a side elevational view in partial section of the pulverizer shown in FIG. 2.

With reference now to FIG. 3, which is an side elevational view in partial section of the pulverizer of the solid fuel pulverizer and exhauster system 28, the one embodiment of the wear plates of the present invention in their operating disposition on the pulverizer will now be described. The pulverizer is a conventional horizontal shaft attrition-type pulverizer having a raw coal inlet 34, a crusher dryer section 36, a pulverizing section 38, a fan section 40, and pulverized coal outlet 42. The crusher dryer section 36 includes a plurality of beater blades 44 all commonly mounted on a main horizontal shaft 46 of the pulverizer, the beater blades 44 cooperating with a grid section 48 to effect an initial size reduction of the raw coal introduced into the pulverizer via the raw coal inlet 34. The pulverizing section 38 includes a rotor disc 50 also mounted on the main horizontal shaft 46 for rotation thereby and a plurality of wear plates 52 mounted on both respective axial surfaces of the rotor disc 50, as will be described in more detail shortly. The fan section 40 includes a plurality of fan vanes 54 mounted at equal angular spacings from one another around the circumference of a fan hub 56 that itself is mounted on the main horizontal shaft 46 for rotation thereby.

Figure 4:
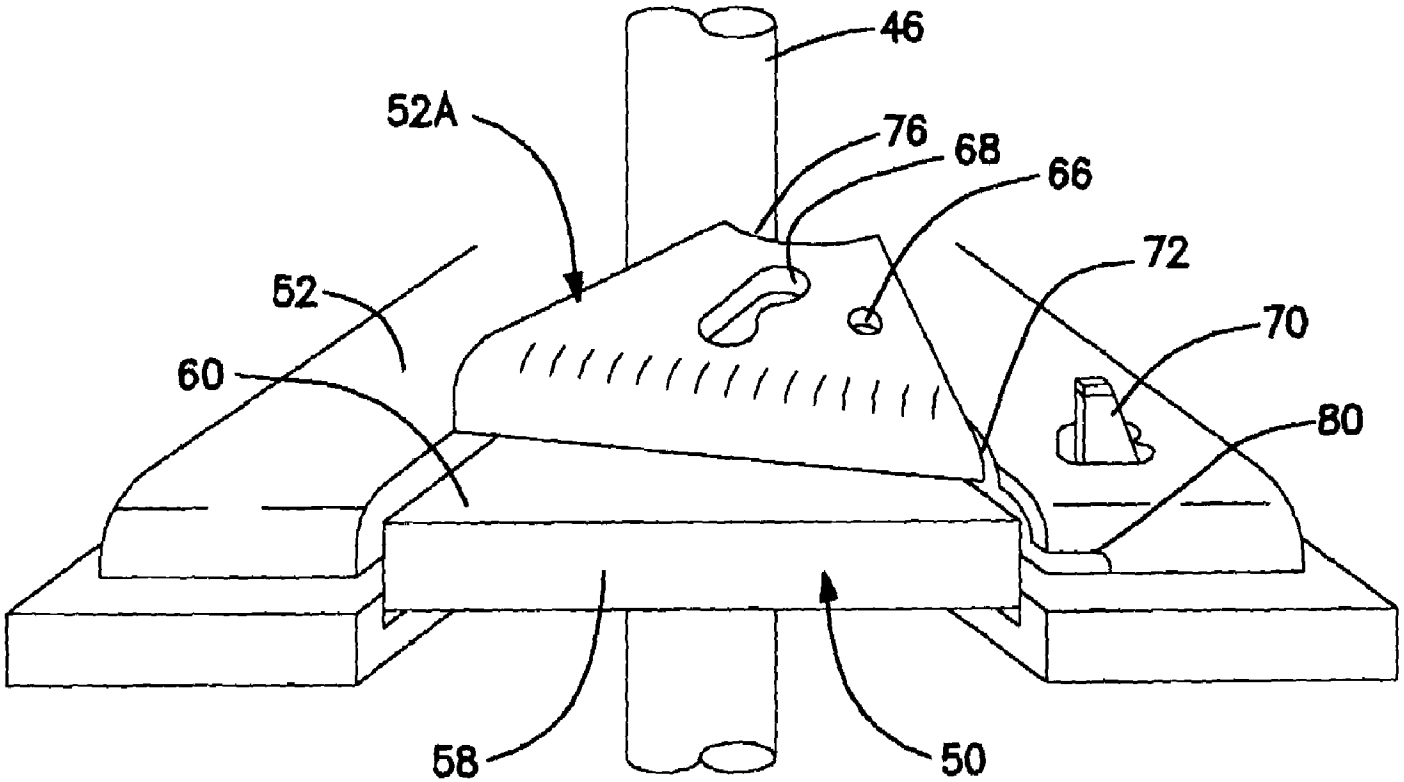
FIG. 4 is an enlarged perspective view of the rotor disc and several units of the one embodiment of the wear plates mounted in the pulverizing section of the pulverizer shown in FIG. 2.

Reference is now had to FIG. 4, which is an enlarged perspective view of the rotor disc 50 and several of the wear plates 52 of the pulverizing section 38 of the pulverizer. The rotor disc 50 has an annular flange 58 having a thickness extent (measured in the axial direction) greater than the thickness extent of the web 60 of the rotor disc 50 that extends radially and supports the annular flange 58. A first set of the wear plates 52 are mounted on one axial side of the web 60 of the rotor disc 50 and a second set of the wear plates 52 are mounted on the opposite axial side of the web 60.

Figure 5:
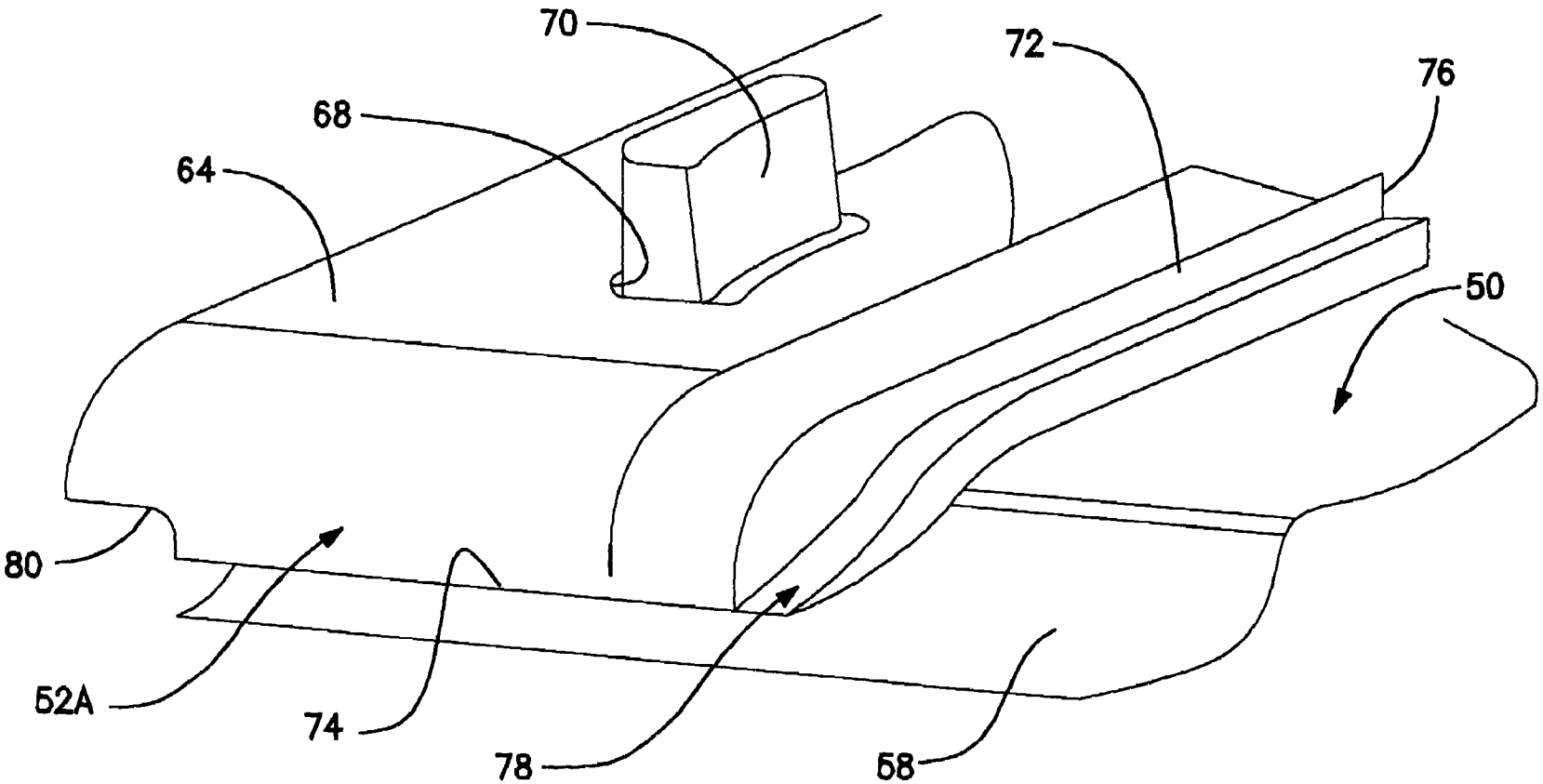
FIG. 5 is an enlarged perspective view of the right-hand side edge of the one embodiment of the wear plates of the present invention shown in FIG. 4.

The wear plates 52 are configured to each provide wear-protecting coverage of a predetermined arcuate extent of the rotor disc 50—namely, a wear-protecting coverage of an arcuate extent of between nine to ten degrees (9 to 10°). The radially extending side edges of each wear plate 52 are specifically configured in accordance with the present invention to engage the mutually facing radially extending side edge of the respective adjacent wear plate 52 so as to advantageously minimize the detrimental effects of the migration of coal particles between adjacent wear plates 52. As seen in FIG. 4 and FIG. 5, within a given set of wear plates 52 that provide wear-protecting coverage to a respective axial side of the rotor disc 50, the same respective left- or right-handed side edges of the wear plates 52 of the given set of wear plates 52 are identically configured while the other respective left- or right-handed side edges of the wear plates 52 of the given set of wear plates 52 are identically configured with one another.

Moreover, the left-hand side edges of the wear plates 52 of each given set of wear plates 52 are configured in correspondence with the right-hand side edges of the wear plates 52 of the same given set of wear plates 52 so as to yield a desirable interengagement between each pair of a side edge of a wear plate 52 and the mutually face side edge of an adjacent wear plate 52 when the set of wear plates 52 are mounted on the one respective axial side of the rotor disc 50.

FIG. 5 is an enlarged perspective view of the right-hand side edge of one of the wear plates 52 mounted on one axial side of the rotor disc 50, hereinafter designated as the wear plate 52A. This right-hand side edge of this wear plate 52A, hereinafter designated as the right-hand side edge 62, is, in accordance with the present invention, correspondingly configured with respect to the left-hand side edges of the wear plates 52 of the respective set of wear plates 52 mounted on this one axial side of the rotor disc 50. The wear plate 52A, which is shown in its rotor disc-mounted disposition in FIG. 5, is shown as well in FIG. 4, which illustrates the wear plate 52A as it is being installed by hand into its corresponding side edge engagements with the respective pair of the wear plates 52 adjacent to the wear plate 52A.

As seen in FIG. 5, the wear plate 52A includes a body portion 64 having a plurality of bores 66 and a cutout 68. The placement of the wear plate 52A onto the one axial side of the rotor disc 50 during the installation process brings each of the bores 66 of the wear plate 52A into registry with an underlying bore in the rotor disc 50 such that a securement bolt can be extended through each respective pair of aligned bores and secured with a nut. Additionally, the placement of the wear plate 52A onto the one axial side of the rotor disc 50 during the installation process brings the cutout 68 into registry with a respective projection 70 projecting axially from the web 60 of the rotor disc 50 such that the projection 70 extends through the cutout 68.

The wear plate 52A also includes an abutment shoulder 72 that extends from the radially outer circumferential edge 74 of the wear plate 52A to its radially inner circumferential edge 76. The abutment shoulder 72 has an linear elongate extent from the inner circumferential edge 76 of the wear plate 52A to a location near the outer circumferential edge 74 of the wear plate 52A, whereat the abutment shoulder has an overall curved hook shape terminating at the outer circumferential edge 74 of the wear plate 52A. The body portion 64 of the wear plate 52A has an overall shape, as viewed from the radially outer circumferential edge 74 of the wear plate 52A to its radially inner circumferential edge 76, that generally tracks the shape of the abutment shoulder 72. Thus, the body portion 64 of the wear plate 52A has a linear elongate extent from its inner circumferential edge 76 to a location near its outer circumferential edge 74, whereat the body portion 64 has an overall curved hook shape terminating at the outer circumferential edge 74 of the wear plate 52A. The axially inner surface of the linear elongate extent of the body portion 64 of the wear plate 52A—that is, the surface of the body portion 64 that is in facing relation to the rotor disc 50—is a generally planar surface.

The wear plate 52A further includes an underlap flange 78 that extends in its width dimension outwardly in the angular direction from the abutment shoulder 72 and extends in its length dimension from the radially outer circumferential edge 74 of the wear plate 52A to its radially inner circumferential edge 76. The underlap flange 78 extends in its thickness dimension in the axial direction from the axially inner surface of the wear plate 52A to a thickness less than the thickness of the abutment shoulder 72.

Figure 6:
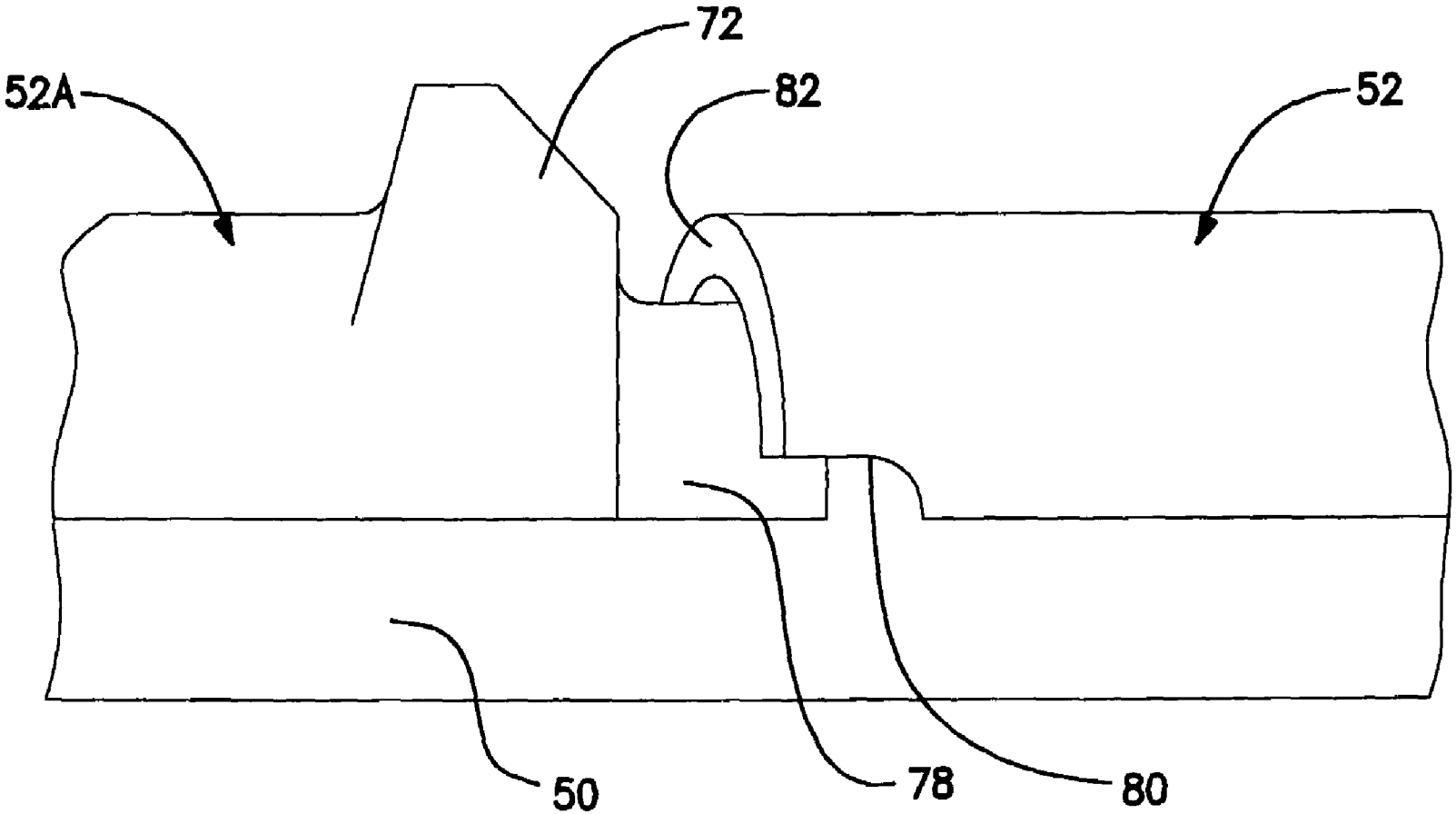
FIG. 6 is an enlarged front elevational view of the right-hand edge of one of the wear plate shown in FIG. 4 and the left-hand edge of a respective adjacent wear plate and showing the overlap rim of the respective adjacent wear plate in partial overlap relationship with the underlap flange of the one wear plate.

The underlap flange 78 of the wear plate 52A is cooperatively configured with respect to an overlap rim 80 of the respective adjacent wear plate 52 that is in interengagement with the right-hand edge of the wear plate 52A. The wear plate 52A has, as do all of the wear plates 52, an overlap rim 80 on its left-hand edge. With reference again to FIG. 4, it can be seen that the overlap rim 80 on the left-hand edge of each wear plate 52 has an axially inner surface whose curvature tracks the curvature of the axially outer surface of the underlap flange 78 of the adjacent wear plate. Apart from the overlap rim 80, the left hand edge of each wear plate 52 has a planar face 82 extending from the radially outer circumferential edge 74 of the wear plate 52 to its radially inner circumferential edge 76. Accordingly, the underlap flange 78 of the wear plate 52A can be inserted into the clearance between the overlap rim 80 of the respective adjacent wear plate 52 and the rotor disc 50 during mounting of the wear plate 52A on the rotor disc 50 such that the overlap rim 80 of the respective adjacent wear plate 52 at least partially overlaps the underlap flange 78 of the wear plate 52A—i.e., the overlap rim 80 of the respective adjacent wear plate 52 is axially outward of, and angularly coincident with, a portion of the underlap flange 78 of the wear plate 52A. FIG. 6 is an enlarged front elevational view of the right-hand edge of the wear plate 52 and the left-hand edge of the respective adjacent wear plate 52 showing the overlap rim 80 of the respective adjacent wear plate 52 in partial overlap relationship with the underlap flange 78 of the wear plate 52A. The insertion of the underlap flange 78 of the wear plate 52A into the clearance between the overlap rim 80 of the respective adjacent wear plate 52 and the rotor disc 50 during mounting of the wear plate 52A on the rotor disc 50 can proceed until the abutment shoulder 72 on the right-hand edge of the wear plate 52A comes into engagement with the facing planar face 82 on the left-hand edge of the respective adjacent wear plate.

Since the invention is susceptible to various modifications and alternative forms, it should be understood that the invention is not intended to be limited to the particular forms disclosed. Rather, the scope of the invention extends to all modifications, equivalents and alternatives falling within the spirit and scope of the invention as defined by the appended claims.

What is claimed is:

1. A wear plate for mounting in a wear protecting disposition on a rotor disc of a pulverizer, the rotor disc being rotatable about a rotor axis, the wear plate comprising:

a body portion having a radially outer circumferential edge and a radially inner circumferential edge, an angular edge extending angularly between the radially outer circumferential edge and the radially inner circumferential edge on one side of the body portion and another angular edge extending angularly between the radially outer circumferential edge and the radially inner circumferential edge on an opposed side of the body portion, an axially inner surface disposed in facing relationship to the rotor disc in the wear protecting disposition of the wear plate on the rotor disc;

an abutment shoulder extending from the radially outer circumferential edge of the body portion to the radially inner circumferential edge of the body portion along the one angular edge of the wear plate, the abutment shoulder having an linear elongate extent from the inner circumferential edge of the body portion to a location near the outer circumferential edge of the body portion, whereat the abutment shoulder has an overall curved hook shape terminating at the outer circumferential edge of the body portion;

an underlap flange on the one angular edge of the body portion, the underlap flange extending in its width dimension outwardly in the angular direction from the abutment shoulder, extending in its length dimension from the radially outer circumferential edge of the body portion to the radially inner circumferential edge of the body portion and extending in its thickness dimension in the axial direction from the axially inner surface of the wear plate to a thickness less than the thickness of the abutment shoulder; and an overlap rim on the other angular edge of the body portion, the underlap flange being cooperatively configured with respect to an overlap rim of a respective adjacent wear plate that is in interengagement with the wear plate such that the overlap rim of the respective adjacent wear plate at least partially overlaps the underlap flange of the wear plate.

2. A wear plate according to claim 1, wherein the body portion has at least one bore for registry with an underlying bore in the rotor disc such that a securement bolt can be extended through the pair of aligned bores and secured with a nut.

3. A wear plate according to claim 1, wherein the overlap rim has an axially inner surface whose curvature tracks the curvature of the axially outer surface of the underlap flange of the adjacent wear plate.

* * * * *